US009434122B2

(12) United States Patent
Hsu

(10) Patent No.: US 9,434,122 B2
(45) Date of Patent: Sep. 6, 2016

(54) PACKAGING BAG LINE-FOLDING AND SEALING MACHINE

(71) Applicant: CHAN LI MACHINERY CO., LTD., Taoyuan (TW)

(72) Inventor: Chi Pin Hsu, Taoyuan (TW)

(73) Assignee: Chan Machinery Co., Ltd., Taoyuan (TW)

( * ) Notice: Subject to any disclaimer, the term of this patent is extended or adjusted under 35 U.S.C. 154(b) by 532 days.

(21) Appl. No.: 13/923,546

(22) Filed: Jun. 21, 2013

(65) Prior Publication Data

US 2014/0187403 A1 Jul. 3, 2014

(30) Foreign Application Priority Data

Dec. 28, 2012 (TW) ..... 101151290 A

(51) Int. Cl.
*B31B 1/26* (2006.01)
*B31B 1/00* (2006.01)

(52) U.S. Cl.
CPC . *B31B 1/26* (2013.01); *B31B 1/00* (2013.01); *B31B 2219/2645* (2013.01); *B31B 2219/29* (2013.01); *B31B 2221/20* (2013.01); *B31B 2221/402* (2013.01)

(58) Field of Classification Search
CPC ... B31B 1/26; B31B 1/00; B31B 2219/2645; B31B 2219/29; B31B 1/90; B31B 1/60; B65B 1/02; B65B 7/04
USPC ..... 493/243, 186, 261, 244, 218, 260, 308, 493/184, 432, 453, 242, 245, 73; 53/370.6, 53/371.9, 372.6, 491, 476, 485
See application file for complete search history.

(56) References Cited

U.S. PATENT DOCUMENTS

| | | | | |
|---|---|---|---|---|
| 2,925,699 A * | 2/1960 | Ozor | B65B 7/08 53/370.6 |
| 6,050,056 A * | 4/2000 | Weisser | B65B 7/02 493/183 |
| 6,971,980 B2 * | 12/2005 | Chiu Chen | B31B 1/88 493/123 |
| 2005/0272584 A1 * | 12/2005 | Zetterstrom | B31B 1/64 493/175 |

FOREIGN PATENT DOCUMENTS

| | | |
|---|---|---|
| CN | 201214488 Y | 4/2009 |
| CN | 201258103 Y | 6/2009 |
| CN | 201484701 U | 5/2010 |

* cited by examiner

*Primary Examiner* — Hemant M Desai
*Assistant Examiner* — Mary Hibbert
(74) *Attorney, Agent, or Firm* — Rosenberg, Klein & Lee

(57) ABSTRACT

A packaging bag line-folding and sealing machine includes a first sealing unit and a second sealing unit for sealing a packaging bag therebetween, a first rocker arm and a second rocker arm mounted at the first sealing unit, a locating block, a first link coupled between the first rocker arm and the locating block, two line-folding units, and two second links coupled between the second rocker arm and the line-folding units for moving the line-folding units to make folding lines on the packaging bag between the first and second sealing units upon movement of the first sealing unit relative to the locating block. The application of the packaging bag line-folding and sealing machine greatly improves the packaging quality of packaging bags, and allows adjustment of the line-folding units to fit different sizes of packaging bags, enhancing user convenience.

8 Claims, 3 Drawing Sheets

PACKAGING BAG LINE-FOLDING AND SEALING MACHINE

BACKGROUND OF THE INVENTION

1. Technical Field

The present invention relates to bag sealing technology and more particularly, to a packaging bag line-folding and sealing machine, which enhances the sealing yield and prolongs the machine lifespan.

2. Description of the Prior Art

Referring to FIG. 1, a front view of a conventional packaging bag line-folding and sealing machine is illustrated. As illustrated, the packaging bag line-folding and sealing machine 10 comprises an upper sealing unit 11, a lower sealing unit 13, a connection rod 15, two guide units 17, and two line-folding units 19. Moving the upper sealing unit 11 will bias the line-folding unit 19 to fold a packaging bag 12 therebetween the upper sealing unit 11 and the lower sealing unit 13, and then to seal the packaging bag 12.

The upper sealing unit 11 and the lower sealing unit 13 are set facing each other, and movable relative to each other to clamp and seal the packaging bag 12. If the upper sealing unit 11 is moved upwards during actual application, the lower sealing unit 13 will be moved downwards to increase the gap 14 between the upper sealing unit 11 and the lower sealing unit 13 for enabling the packaging bag 12 to be moved through the gap 14 between the upper sealing unit 11 and the lower sealing unit 13.

After the packaging bag 12 has been delivered to a predetermined position, the upper sealing unit 11 will be moved downwards and the lower sealing unit 13 will be moved upwards, causing the upper sealing unit 11 and the lower sealing unit 13 to clamp and heat the packaging bag 12, finishing the packaging bag sealing operation. In order to improve the packaging bag 12 sealing quality, the line-folding units 19 are controlled to make a folding line one side, for example, the opposing side panels of the packaging bag 12 prior to the action of driving the upper sealing unit 11 and the lower sealing unit 13 to seal the packaging bag 12.

The two guide units 17 are coupled to the upper sealing unit 11, each defining therein a groove 171. The line-folding units 19 each have one end thereof respectively coupled to the connection rod 15, and are respectively coupled to the grooves 171 of the guide units 17 by a respective coupling device 191 that is movable along the mating groove 171. When moving the upper sealing unit 11 relative to the connection rod 15, the line-folding units 19 are moved along the grooves 171 of the respective guide units 17, causing the line-folding units 19 to turn about the connection rod 15.

During movement of the upper sealing unit 11 and the lower sealing unit 13 toward the packaging bag 12, the line-folding units 19 will be moved toward the opposing side panels of the packaging bag 12 to compress the packaging bag 12, making a folding line on the packaging bag 12. Thereafter, the upper sealing unit 11 and the lower sealing unit 13 start sealing the packaging bag 12.

The aforesaid prior art packaging bag line-folding and sealing machine 10 can make a folding line on a packaging bag 12 and then seal it, however it is still not satisfactory in function. At first, the line-folding units 19 of the packaging bag line-folding and sealing machine 10 are movable by a swinging action. When driving the line-folding units 19 to make a folding line on the packaging bag 12, the folding line thus made may be not presented in an accurately symmetric condition, affecting the packaging quality of the packaging bag 12. Further, if the size (width and/or height) of the packaging bag 12 is changed, the operator must adjust the relative positions of the upper sealing unit 11, the lower sealing unit 13, the connection rod 15, the guide units 17 and/or the line-folding units 19, enabling the line-folding units 19 to make a folding line on the packaging bag 12. However, because multiple component parts must be adjusted, these component parts will affect one another during adjustment. Thus, this adjustment needs quite a bit of time to finish.

SUMMARY OF THE PRESENT INVENTION

It is, therefore, the main object of the present invention to provide a packaging bag line-folding and sealing machine, which enables the line-folding units thereof to be moved linearly to make symmetrical folding lines on the packaging bag to be sealed, improving the packaging quality of the packaging bag.

It is another object of the present invention to provide a packaging bag line-folding and sealing machine, which allows the operator to adjust the packaging bag line-folding and sealing machine to fit different sizes of packaging bags simply by means of adjusting the position and/or elevation of the line-folding member of each line-folding unit, enhancing application usability and user convenience.

It is still another object of the present invention to provide a packaging bag line-folding and sealing machine, which uses protective members to drive line-folding units, providing better protection to the packaging bag line-folding and sealing machine to reduce the chance of damage to the component parts.

To achieve the above mentioned and other objectives, the present invention provides a packaging bag line-folding and sealing machine, comprising: a first sealing unit; a second sealing unit facing toward the first sealing unit and movable relative to the first sealing unit to seal a packaging bag therebetween; a locating block; a first link coupled to the locating block; a first rocker arm mounted at the first sealing unit and coupled to the first link, the first rocker arm being movable by the first link to swing upon movement of the first sealing unit relative to the locating block; a second rocker arm connected to the first rocker arm and movable by the first rocker arm to swing; two line-folding units respectively coupled to the two second links and movable relative to each other by the second links to fold a packaging bag therebetween upon a swinging action of the second rocker arm.

In one embodiment of the packaging bag line-folding and sealing machine, wherein each the second link is a retractable protective member.

In one embodiment of the packaging bag line-folding and sealing machine, wherein each the line-folding unit comprises at least one connection member, at least one first sliding rail, at least one adjustment member and at least one line-folding member.

In one embodiment of the packaging bag line-folding and sealing machine, wherein the at least one connection member is located at the at least one first sliding rail and connected with the at least one adjustment member and one the second link, and the at least one line-folding member is connected with the at least one adjustment member in such a manner that the at least one line-folding member is movable to fold a packaging bag between the line-folding units upon movement of the at least one connection member along the at least one first sliding rail.

In one embodiment of the packaging bag line-folding and sealing machine, further comprising at least one second sliding rail adapted to support the first sealing unit, the second sealing unit and the locating block.

In one embodiment of the packaging bag line-folding and sealing machine, wherein each the line-folding unit further comprises a locating member mounted at the second sliding rail to support the at least one first sliding rail.

In one embodiment of the packaging bag line-folding and sealing machine, wherein the at least one first sliding rail and the second sliding rail are kept in a substantially orthogonal manner.

In one embodiment of the packaging bag line-folding and sealing machine, wherein the first sealing unit and the second sealing unit are movable in a first direction, and the line-folding units are movable in a second direction substantially perpendicular to the first direction.

In one embodiment of the packaging bag line-folding and sealing machine, wherein the first rocker arm comprises a fulcrum and a swing portion and the first link is coupled to the swing portion of the first rocker arm.

In one embodiment of the packaging bag line-folding and sealing machine, wherein the second rocker arm comprises a fulcrum connected to the fulcrum of the first rocker arm, and two swing portions respectively coupled to the second links.

DETAILED DESCRIPTION OF THE PREFERRED EMBODIMENTS

Figure 1:
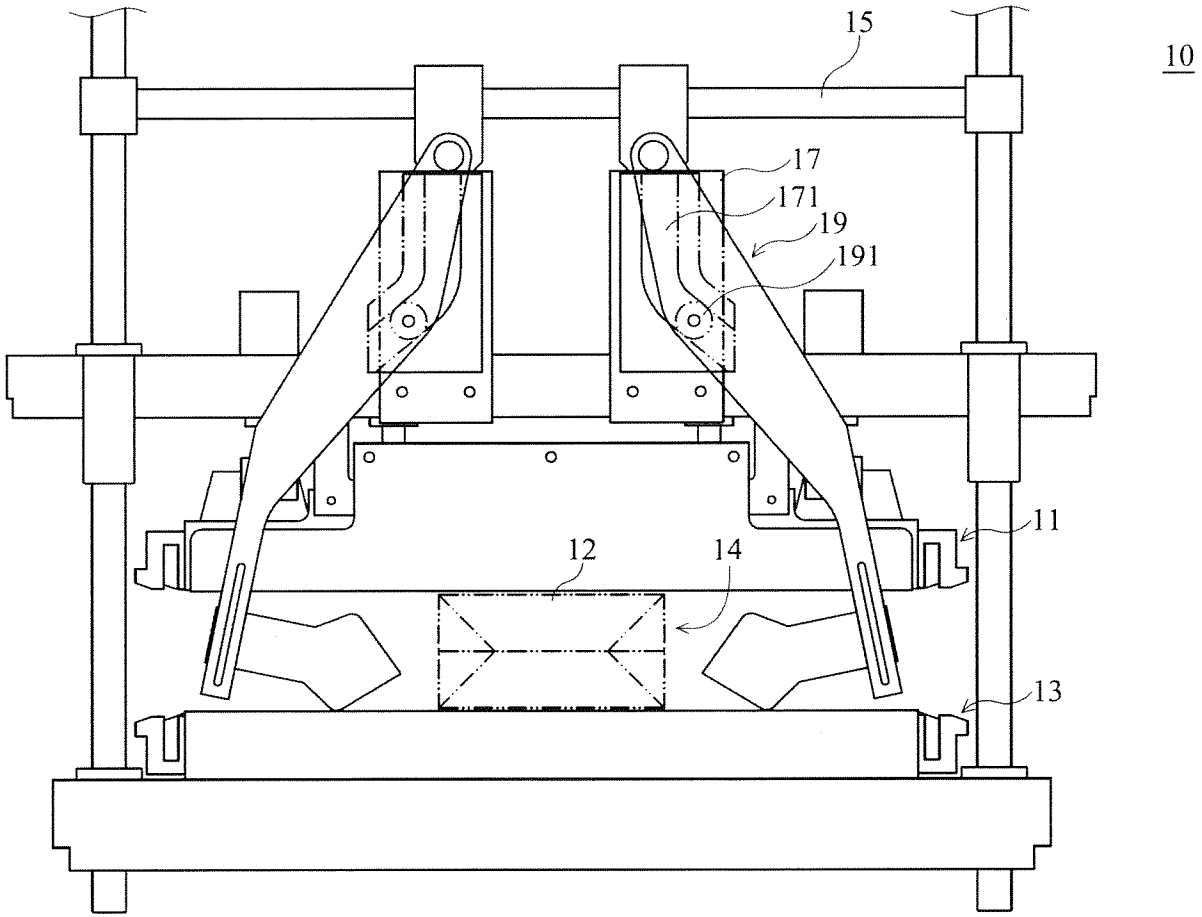
FIG.1 (PRIOR ART)
FIG. 1 is a schematic front view of a packaging bag line-folding and sealing machine according to the prior art.
Figure 2:
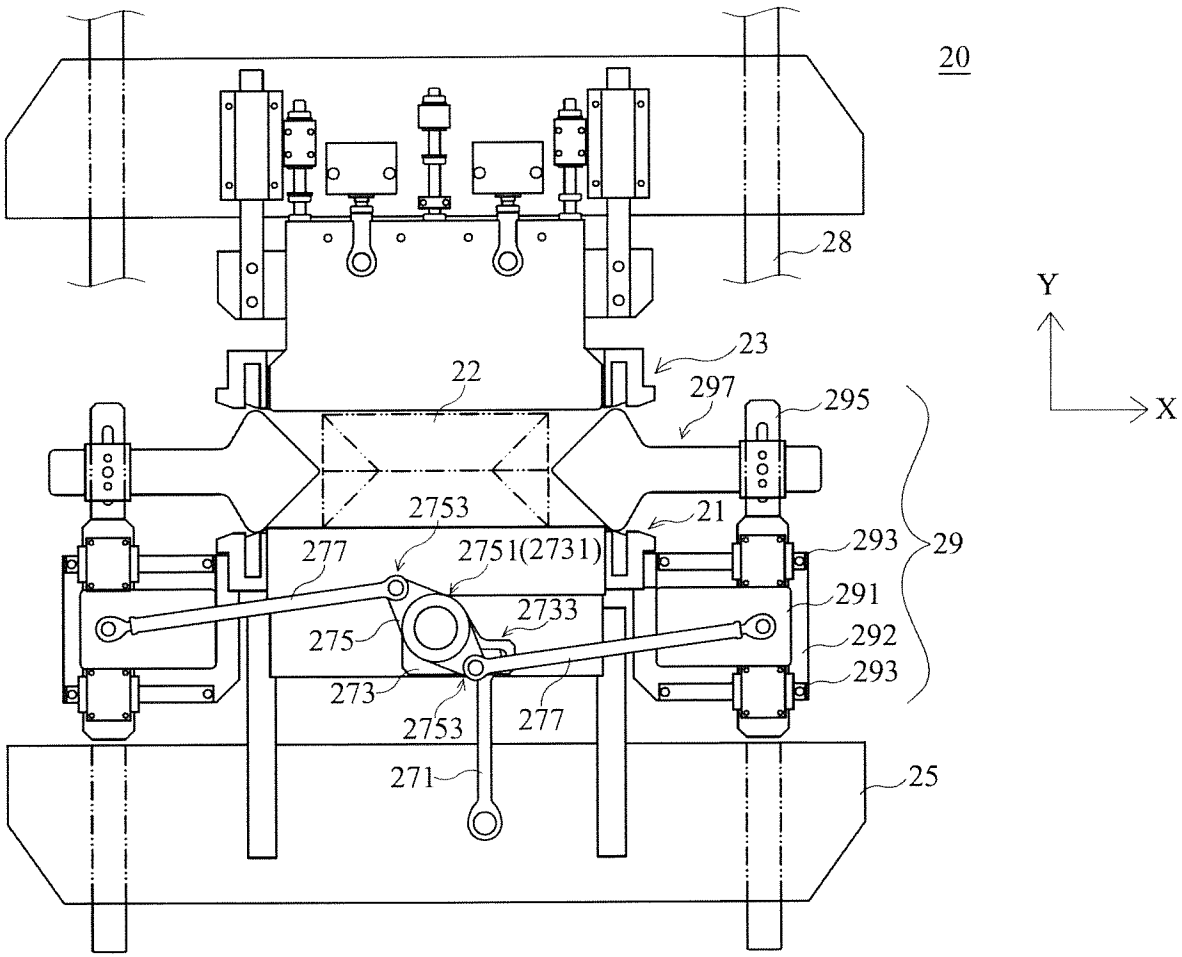
FIG. 2 is a schematic front view of a packaging bag line-folding and sealing machine in accordance with a first embodiment of the present invention.

Referring to FIG. 2, a front view of a packaging bag line-folding and sealing machine in accordance with a first embodiment of the present invention is illustrated. As illustrated, the packaging bag line-folding and sealing machine 20 comprises a first sealing unit 21, a second sealing unit 23, a locating block 25, a first link 271, a first rocker arm 273, a second rocker arm 275, a plurality of for example, two second links 277, and two line-folding units 29.

The first sealing unit 21 and the second sealing unit 23 are set facing each other and movable relative to each other between an open position and a close position. In one embodiment, the first sealing unit 21 is disposed at the bottom side, and the second sealing unit 23 is disposed above the first sealing unit 21. During working of the packaging bag line-folding and sealing machine 20, the first sealing unit 21 and the second sealing unit 23 are moved in reversed directions, for example, when moving the first sealing unit 21 upwards, the second sealing unit 23 is moved downwards, and therefore, the first sealing unit 21 and the second sealing unit 23 can clamp a packaging bag 2 therebetween and then seal the packaging bag 2.

The first rocker arm 273 and the second rocker arm 275 are coupled together and arranged on the first sealing unit 21. In one embodiment, the first rocker arm 273 comprises a fulcrum 2731 and a swing portion 2733, and the second rocker arm 275 comprises a fulcrum 2751 and two swing portions 2753. The fulcrum 2731 of the first rocker arm 273 is connected to the fulcrum 2751 of the second rocker arm 275. Thus, forcing the first rocker arm 273 to swing will drive the second rocker arm 275 to swing. In one embodiment, the fulcrum 2731 of the first rocker arm 273 and the fulcrum 2751 of the second rocker arm 275 are coincided with each other and coupled to the first sealing unit 21, allowing the first rocker arm 273 and the second rocker arm 275 to be oscillated back and forth relative to the first sealing unit 21.

The locating block 25 is disposed adjacent to the first sealing unit 21, and coupled to the first rocker arm 273 at the first sealing unit 21 by the first link 271, for example, coupled to the swing portion 2733 of the first rocker arm 273 by the first link 271. When operating the packaging bag line-folding and sealing machine 20 to seal a packaging bag 22, the locating block 25 is kept immovable, and the first sealing unit 21 is movable relative to the locating block 25. During movement of the first sealing unit 21 relative to the locating block 25, the first link 271 at the locating block 25 will carry the first rocker arm 273 to swing, causing the second rocker arm 275 to swing.

The two swing portions 2753 of the second rocker arm 275 are respectively coupled to respective one ends of the second links 277. The respective other ends of the second links 277 are respectively coupled to the line-folding units 29. During swinging of the second rocker arm 275 about the axis extending through its fulcrum 2751, the two second links 277 will move the line-folding units 29 in reversed directions to compress the packaging bag 22.

In one embodiment, the first sealing unit 21 and the second sealing unit 23 are movable in a first direction Y, the two line-folding units 29 are movable in a second direction X substantially perpendicular to the first direction Y. Further, when moving the first sealing unit 21 and the second sealing unit 23 toward the packaging bag 22, the two line-folding units 29 will also be moved toward the packaging bag 22.

In actual application, the two line-folding units 29 are disposed at opposing left and right sides relative to the packaging bag 22 to be sealed, and moved toward the opposing side panels of the packaging bag 22. After the line-folding units 29 touched the packaging bag 22, the two opposing side panels of the packaging bag 22 are folded inwards. The first sealing unit 21 and the second sealing unit 23 are respectively disposed at opposing top and bottom sides relative to the packaging bag 22 to be sealed, and moved toward the packaging bag 22 to clamp and seal the laterally inwardly folded packaging bag 22.

The packaging bag line-folding and sealing machine 20 is characterized by the relative motion between the first sealing unit 21 and the locating block 25 to move the first link 271, the first rocker arm 273, the second rocker arm 275 and the second links 277, driving the line-folding unit 29 to make folding lines on the packaging bag 22. By means of adjusting the relative positions or lengths among the locating block 25, the first sealing unit 21, the first link 271, the first rocker arm 273, the second rocker arm 275, the second links 277 and/or the line-folding units 29, the line-folding units 29 can make folding lines on the packaging bag 22 at a selected location. Further, the first sealing unit 21 and the second sealing unit 23 will seal the packaging bag 22 only after the line-folding units 29 have make folding lines on the packaging bag 22 at the selected location.

In one embodiment, each line-folding unit 29 comprises a connection member 291, at least one first sliding rail 293, at least one adjustment member 295 and at least one line-folding member 297. The connection member 291 is located at the first sliding rail 293, and connected to one respective second link 277. The adjustment member 295 is located at the connection member 291, and connected to the line-folding member 297. During the operation to make folding lines on the packaging bag 22, the respective second link 277 will move the connection member 291 along the first sliding rail 293, causing the line-folding member 297 to fold the respective side panel of the packaging bag 22 to be sealed. During an adjustment operation, the line-folding member 297 can be moved along the adjustment member 295 to the desired position, enabling the line-folding member 297 to make a folding line on the packaging bag 22 at a predetermined location.

Because each second link 277 has its one end coupled to the second rocker arm 275 and its other end coupled to the connection member 291, swinging the second rocker arm 275 can drive the second links 277 to move the connection members 291 of the line-folding units 29 along the respective first sliding rails 293, causing the respective line-folding members 297 to move in the second direction X and to make folding lines on the packaging bag 22.

Unlike the swinging action of the line-folding units 19 of the prior art packaging bag line-folding and sealing machine 10, the line-folding units 29 of the packaging bag line-folding and sealing machine 20 of the present invention are linearly movable in the second direction (for example, horizontal direction) X to make symmetrical (top and bottom) folding lines on the packaging bag 22, improving the packaging quality of the packaging bag 22.

When using the packaging bag line-folding and sealing machine 20 to seal packaging bags 22 of a different size, the operator can fix the relative positions of the first sealing unit 21, the locating block 25, the first link 271, the first rocker arm 273, the second rocker arm 275 and the second links 277, and then adjust the elevation of the second sealing unit 23 and the position of the line-folding units 29, for example, the elevations and lengths of the line-folding members 297 of the line-folding units 29. Thus, the packaging bag line-folding and sealing machine 20 is applicable to seal packaging bags 22 with different sizes. When compared to the prior art packaging bag line-folding and sealing machine 10, the adjustment of the packaging bag line-folding and sealing machine 20 of the present invention is much easy, shortening the time the operator required to calibrate the packaging bag line-folding and sealing machine 20.

In one embodiment, the line-folding and sealing machine 20 further comprises at least one second sliding rail 28 adapted to support the first sealing unit 21, the second sealing unit 23 and/or the locating block 25, facilitating adjustment of relative positions among the first sealing unit 21, the second sealing unit 23 and/or the locating block 25 for enabling the packaging bag line-folding and sealing machine 20 to fold and seal different sizes of packaging bags 22.

In one embodiment, each line-folding unit 29 further comprises a locating member 292 mounted on one respective second sliding rail 28 to support the associate first sliding rail 293 in a substantially orthogonal manner.

When adjusting the packaging bag line-folding and sealing machine 20, the position of the first sealing unit 21 and/or the position of the locating block 25 are normally remained unchanged, the operator simply needs to lift or lower the second sealing unit 23, allowing the packaging bag 22 to be delivered through the gap between the first sealing unit 21 and the second sealing unit 23 and the first sealing unit 21 and the second sealing unit 23 to clamp and seal the packaging bag 22. Thereafter, adjust the line-folding units 29 to move the line-folding members 297 to the position about one half of the height of the packaging bag 22 where the line-folding members 297 can fold the packaging bag 22 to make symmetrical folding lines on the packaging bag 22.

Figure 3:
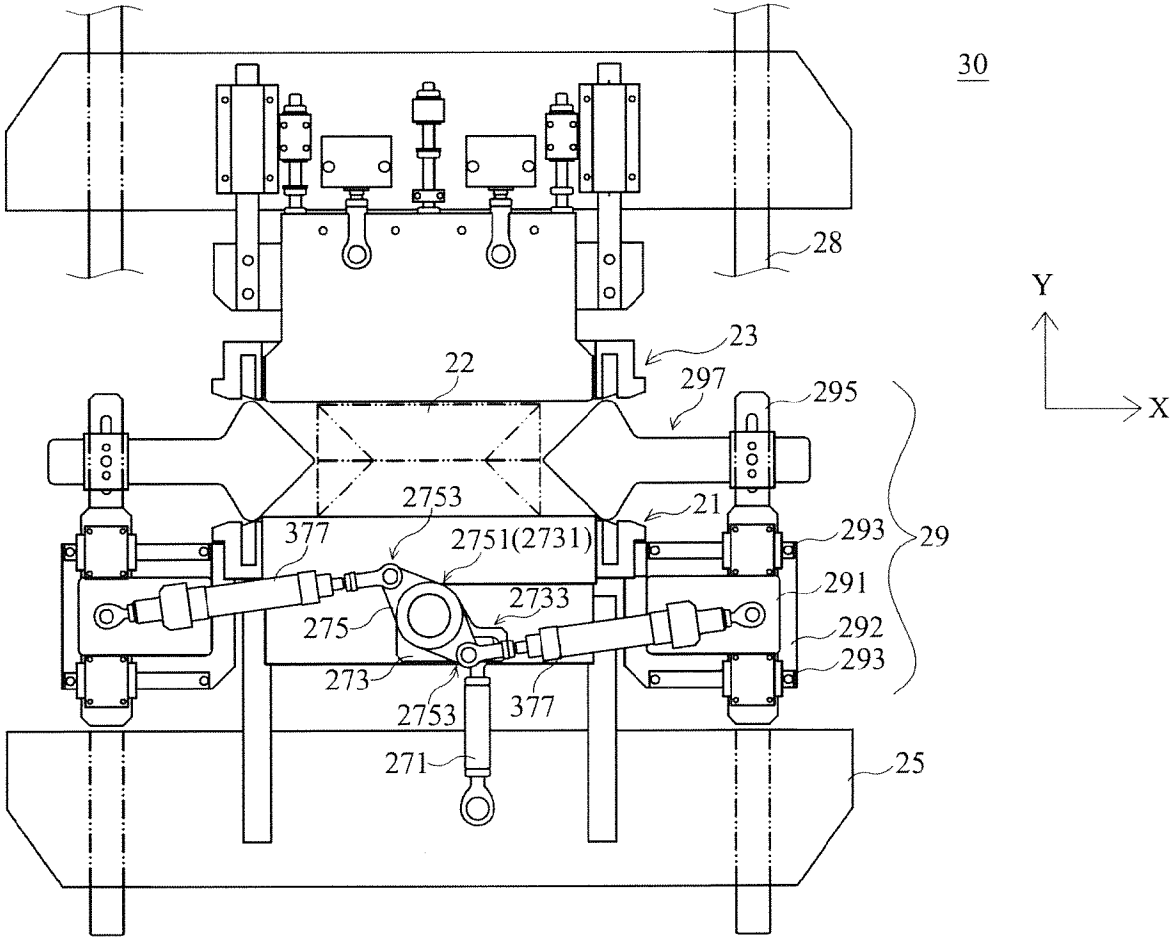
FIG. 3 is a schematic front view of a packaging bag line-folding and sealing machine in accordance with a second embodiment of the present invention.

The second links 277 of the packaging bag line-folding and sealing machine 20 in accordance with the first embodiment of the present invention as illustrated in FIG. 2 can be substituted by respective protective members. In a second embodiment of the present invention, as illustrated in FIG. 3, protective members 377 are used in the packaging bag line-folding and sealing machine 30 and coupled between the second rocker arm 275 and the line-folding units 29. The second rocker arm 275 can move the line-folding units 29 by means of the respective protective members 377.

In this second embodiment, the protective members 377 are protective air cylinders. If the external pressure applied to the opposite ends of the protective members 377 surpasses the protective pressure of the protective air cylinders, the protective members 377 will be forced to retract or expand. If the external pressure applied to the opposite ends of the protective members 377 is within the range of the protective pressure of the protective air cylinders, the protective members 377 will not be forced to retract or expand, and will work like the second links 277, allowing the second rocker arm 275 to move the line-folding units 29 through the protective members 377.

The arrangement of the protective members 377 can protect the component parts of the packaging bag line-folding and sealing machine 30 against damage. For example, if an internal component part of the packaging bag line-folding and sealing machine 30 is stuck, the protective members 377 can be forced by the applied external force to expand or retract, avoiding transmission of the applied external force to other component parts, lowering the risk of component damage.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A packaging bag line-folding and sealing machine, comprising:

a first sealing unit;

a second sealing unit facing toward said first sealing unit and movable relative to said first sealing unit to seal a packaging bag therebetween;

a locating block;

a first link coupled to said locating block;

a first rocker arm mounted at said first sealing unit and coupled to said first link, said first rocker arm being movable by said first link to swing upon movement of said first sealing unit relative to said locating block;

a second rocker arm connected to said first rocker arm and movable by said first rocker arm to swing;

two second links respectively coupled to said second rocker arm; and two line-folding units respectively coupled to said two second links and movable relative to each other by said second links to fold a packaging bag therebetween upon a swinging action of said second rocker arm;

wherein each said line-folding unit comprises at least one connection member, at least one first sliding rail, at least one adjustment member and at least one line-folding member; and wherein said at least one connection member is located at said at least one first sliding rail and connected with said at least one adjustment member and one said second link, and said at least one line-folding member is connected with said at least one adjustment member in such a manner that said at least one line-folding member is movable to fold a packaging bag between said line-folding units upon movement of said at least one connection member along said at least one first sliding rail.

2. The packaging bag line-folding and sealing machine as claimed in claim 1, wherein each said second link is a retractable protective member.

3. The packaging bag line-folding and sealing machine as claimed in claim 1, further comprising at least one second sliding rail adapted to support said first sealing unit, said second sealing unit and said locating block.

4. The packaging bag line-folding and sealing machine as claimed in claim 3, wherein each said line-folding unit further comprises a locating member mounted at said second sliding rail to support said at least one first sliding rail.

5. The packaging bag line-folding and sealing machine as claimed in claim 3, wherein said at least one first sliding rail and said second sliding rail are kept in a substantially orthogonal manner.

6. The packaging bag line-folding and sealing machine as claimed in claim 1, wherein said first sealing unit and said second sealing unit are movable in a first direction, and said line-folding units are movable in a second direction substantially perpendicular to said first direction.

7. The packaging bag line-folding and sealing machine as claimed in claim 1, wherein said first rocker arm comprises a fulcrum and a swing portion and said first link is coupled to the swing portion of said first rocker arm.

8. The packaging bag line-folding and sealing machine as claimed in claim 7, wherein said second rocker arm comprises a fulcrum connected to the fulcrum of said first rocker arm, and two swing portions respectively coupled to said second links.

* * * * *